US009944070B1

(12) United States Patent
Howkins et al.

(10) Patent No.: US 9,944,070 B1
(45) Date of Patent: Apr. 17, 2018

(54) DETERMINATION OF A MAXIMUM JETTING FREQUENCY FOR AN INKJET HEAD

(71) Applicants: Stuart Howkins, Exeter, NH (US); Charles Willus, Newtown, CT (US)

(72) Inventors: Stuart Howkins, Exeter, NH (US); Charles Willus, Newtown, CT (US)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/436,674

(22) Filed: Feb. 17, 2017

(51) Int. Cl.
*B41J 2/045* (2006.01)

(52) U.S. Cl.
CPC ..... *B41J 2/0451* (2013.01); *B41J 2/04586* (2013.01)

(58) Field of Classification Search
None
See application file for complete search history.

(56) References Cited

U.S. PATENT DOCUMENTS

2011/0164331 A1* 7/2011 Sugiyama ..... H02N 2/062 359/823

* cited by examiner

*Primary Examiner* — Lisa M Solomon
(74) *Attorney, Agent, or Firm* — Duft Bornsen & Fettig LLP

(57) ABSTRACT

Determination of a maximum jetting frequency for an inkjet head. The method includes generating a velocity/frequency curve for an inkjet head, and determining failure zones in the velocity/frequency curve that comprise frequencies in the velocity/frequency curve resulting in jetting failure of the inkjet head. The method further includes determining a range of maximum jetting frequencies of the inkjet head that are higher than the frequencies of the failure zones, wherein subharmonic frequencies of each of the maximum jetting frequencies are outside of the failure zones. The method further includes selecting the maximum jetting frequency for the inkjet head from the range of maximum jetting frequencies.

20 Claims, 10 Drawing Sheets

DETERMINATION OF A MAXIMUM JETTING FREQUENCY FOR AN INKJET HEAD

FIELD OF THE INVENTION

The following disclosure relates to the field of printing, and in particular, to inkjet heads used in printing.

BACKGROUND

Inkjet printing is a type of printing that propels drops of ink (also referred to as droplets) onto a medium, such as paper, a substrate for 3D printing, etc. The core of an inkjet printer includes one or more print heads (referred to herein as inkjet heads) having multiple ink channels arranged in parallel to discharge droplets of ink. A typical ink channel has elements including a nozzle, a chamber, a narrow channel for feeding ink into the chamber (restrictor), and a mechanism for ejecting the ink from the chamber and through the nozzle, which is typically a piezoelectric actuator connected to a thin, flexible diaphragm which forms part of the chamber wall. The parameters of the channel elements, size, geometry, material properties, etc., together with the fluidic properties of the ink all play a role in determining the properties of the jet, drop size, drop velocity, ligament structure, maximum frequency, etc.

To discharge a droplet from an ink channel, a drive circuit provides a jetting pulse to the piezoelectric actuator of that ink channel. In response to the jetting pulse, the piezoelectric actuator pushes on the diaphragm generating a momentary high pressure inside of the ink channel to push the droplet out of the nozzle. The jetting pulse has a drive waveform designed in conjunction with the inkjet head channel elements and ink parameters to control how droplets are ejected from each of the ink channels. The drive waveform of the jetting pulse is thus designed to optimize performance for each head, ink, and application.

One consideration in the design is that, in addition to the desired momentary high pressure inside the chamber, the drive waveform also excites two chamber resonances known as the Helmholtz and Slosh modes resulting in undesirable pressure oscillations and a long recovery time inside the chamber following the expulsion of the droplet. This "ringing" and slow exponential recovery of the ink meniscus can persist in a channel for a long enough time that chamber equilibrium will not have been reached by the time of the next firing required for that channel. The next firing can thus generate a droplet having a different volume/velocity and stability from that of the preceding drop.

In the past, this problem has been addressed in two ways:

(a) The damping of the ringing can be increased by making the total resistance in the channel somewhat larger. This can be done by increasing the resistance of the restrictor and the orifice. It should be noted that the Helmholtz damping is controlled by a resistance, $R_H$, which is the parallel combination of the restrictor $R_r$ and the orifice $R_o$:

$$R_H=R_rR_o/(R_r+R_o).$$

When the orifice resistance is made very large: $R_H \rightarrow R_r$ as $R_o \rightarrow \infty$. When the restrictor resistance is made very large: $R_H \rightarrow R_o$ as $R_r \rightarrow \infty$. However, the Slosh mode damping is controlled by a resistance, $R_s$, which is the series combination of $R_r$ and $R_o$:

$$R_S=R_r+R_o$$

In most cases the Slosh mode frequency, S, is much lower than H and also $R_S$ is close to critical damping. For $R_S$>=critical damping, increasing $R_S$ will only serve to increase the time for meniscus recovery. In practice we see that after firing, the meniscus returns exponentially and slowly under the Slosh mode with a damped Helmholtz oscillation riding on the return. The best results for minimum variation of drop velocity/volume with frequency are obtained from a compromise between lower Slosh damping and higher Helmholtz damping.

(b) The drive waveform can be designed with a segment of the waveform in which the meniscus Helmholtz ringing is driven 180° out of phase with its motion (clamping). However, because the equations describing meniscus recovery are non-linear, the timing of an out-of-phase segment is also important. For example, when the meniscus first starts to return to its rest position from a deep retraction, the recovery is initially governed mostly by the Helmholtz oscillation and is relatively rapid. This allows the possibility of allowing an initially uninterrupted rapid recovery before starting the out-of-phase segment having a "braking pulse" to avoid overshooting just before full recovery is reached.

Printing speed is directly dependent upon the number of jets and the maximum jetting frequency of the jets. Therefore, a high maximum jetting frequency is beneficial in that higher printing speeds are provided to customers. However, jetting at high frequencies requires a short time interval between jet firings resulting in drop velocity and drop mass which exhibit the largest fluctuations with frequency. The amplitude of these large fluctuations at high frequencies leads to errors in the volume, shape, and position of the drops deposited on a print medium. Presently, to determine the maximum jetting frequency of an inkjet head, the inkjet head is tested by firing a jet on a test stand at a constant frequency, and measuring drop velocity and/or mass. The frequency is slowly increased until the jet fails. The frequency at which the inkjet head fails is considered the maximum jetting frequency of the inkjet head. Tests such as this are commonly used to define a limitation on the maximum jetting frequency, which in turn, may limit the printing speed of the inkjet head. It can therefore be concluded that the old method of determining the maximum operating frequency is unnecessarily restrictive.

SUMMARY

Embodiments described herein provide systems, methods, and software for determining a maximum jetting frequency (Fmax) of an inkjet head. An exemplary method performs testing, simulation, or a combination of testing and simulation to generate a velocity/frequency curve for an inkjet head. There are regions of the velocity/frequency curve that indicate jetting failure for the inkjet head, and these regions are identified as failure zones. The failure zones indicate constraints on the Fmax that can be selected for this inkjet head. An optimal Fmax is selected for the inkjet head so that the sub-harmonic series of the optimal Fmax will lie outside of the failure zones. The manner of selecting an optimal Fmax as described in the embodiments below allows for a higher Fmax than before. Instead of selecting a maximum frequency based on the frequency at which the inkjet head initially fails, a new maximum frequency, "Fmax", is selected when the velocity/frequency curve shows that the inkjet head may recover from a failure condition as frequency is increased. Thus, an Fmax may be selected at frequencies higher than a frequency where the inkjet head initially fails. This advantageously allows the inkjet head to operate at higher printing speeds when installed in a printer.

One embodiment is a method of selecting a maximum jetting frequency for an inkjet head. The method includes generating a velocity/frequency curve for an inkjet head, and determining failure zones in the velocity/frequency curve that comprise frequencies in the velocity/frequency curve resulting in jetting failure of the inkjet head. The method further includes determining a range of maximum jetting frequencies of the inkjet head that are higher than the frequencies of the failure zones, where subharmonic frequencies of each of the maximum jetting frequencies are outside of the failure zones. The method further includes selecting a maximum jetting frequency for the inkjet head from the range of maximum jetting frequencies.

In another embodiment, the step of selecting a maximum jetting frequency from the range of maximum jetting frequencies comprises selecting a highest frequency in the range of maximum jetting frequencies as the maximum jetting frequency.

In another embodiment, the step of selecting a maximum jetting frequency from the range of maximum jetting frequencies comprises selecting the maximum jetting frequency from the range of maximum jetting frequencies that results in a minimum velocity spread across the subharmonic frequencies.

In another embodiment, the step of selecting a maximum jetting frequency from the range of maximum jetting frequencies comprises selecting the maximum jetting frequency from the range of maximum jetting frequencies that results in a minimum drop placement spread across the subharmonic frequencies.

In another embodiment, the method further comprises determining a mass/frequency curve for the inkjet head, and determining the failure zones in the mass/frequency curve.

In another embodiment, the step of generating the velocity/frequency curve comprises supplying a print fluid to the inkjet head, supplying a drive waveform for driving the inkjet head, and measuring drop velocity of the inkjet head over a set of increasing frequencies in the drive waveform.

In another embodiment, the step of generating the velocity/frequency curve comprises simulating jetting of the inkjet head over a set of increasing frequencies.

In another embodiment, the step of determining the failure zones in the velocity/frequency curve comprises determining a Helmholtz frequency (H) of the inkjet head, determining a first one of the failure zones around H/2, and determining a second one of the failure zones around 2H/3.

Another embodiment comprises a test system for determining a maximum jetting frequency for an inkjet head. The test system includes a test controller comprising a curve generator that generates a velocity/frequency curve for the inkjet head. The test controller further comprises a determination device that determines failure zones in the velocity/frequency curve that comprise frequencies in the velocity/frequency curve resulting in jetting failure of the inkjet head, and determines a range of maximum jetting frequencies of the inkjet head that are higher than the frequencies of the failure zones, where subharmonic frequencies of each of the maximum jetting frequencies are outside of the failure zones. The determination device selects the maximum jetting frequency for the inkjet head from the range of maximum jetting frequencies.

In another embodiment, the determination device selects a highest frequency in the range of maximum jetting frequencies as the maximum jetting frequency.

In another embodiment, the determination device selects the maximum jetting frequency from the range of maximum jetting frequencies that results in a minimum velocity spread across the subharmonic frequencies.

In another embodiment, the determination device selects the maximum jetting frequency from the range of maximum jetting frequencies that results in a minimum drop placement spread across the subharmonic frequencies.

In another embodiment, the determination device determines a mass/frequency curve for the inkjet head, and determines the failure zones in the mass/frequency curve.

In another embodiment, the test system further includes a test stand that secures the inkjet head, an ink supply that supplies a print fluid to the inkjet head, a test drive circuit that supplies a drive waveform for driving the inkjet head, and a droplet analyzer that measures drop velocity of the inkjet head over a set of increasing frequencies in the drive waveform.

In another embodiment, the test system further includes a jetting simulator that simulates jetting of the inkjet head over a set of increasing frequencies to generate the velocity/frequency curve.

In another embodiment, the determination device determines a Helmholtz frequency (H) of the inkjet head, determines a first one of the failure zones around H/2, and determines a second one of the failure zones around 2H/3.

In another embodiment, the test system further includes a user interface that receives performance goals for the inkjet head from a user, wherein the performance goals include at least one of a minimum velocity spread across the subharmonic frequencies and a minimum drop placement spread across the subharmonic frequencies.

Another embodiment comprises a non-transitory computer readable medium embodying programmed instructions executed by a processor to implement a method for selecting a maximum jetting frequency for an inkjet head, wherein the instructions direct the processor to generate a velocity/frequency curve for the inkjet head, determine failure zones in the velocity/frequency curve that comprise frequencies in the velocity/frequency curve resulting in jetting failure of the inkjet head, determine a range of maximum jetting frequencies of the inkjet head that are higher than the frequencies of the failure zones, wherein subharmonic frequencies of each of the maximum jetting frequencies are outside of the failure zones, and select a maximum jetting frequency for the inkjet head from the range of maximum jetting frequencies.

The above summary provides a basic understanding of some aspects of the specification. This summary is not an extensive overview of the specification. It is intended to neither identify key or critical elements of the specification nor delineate any scope particular embodiments of the specification, or any scope of the claims. Its sole purpose is to present some concepts of the specification in a simplified form as a prelude to the more detailed description that is presented later.

DESCRIPTION OF THE DRAWINGS

Some embodiments of the present disclosure are now described, by way of example only, and with reference to the accompanying drawings. The same reference number represents the same element or the same type of element on all drawings.

DETAILED DESCRIPTION

The figures and the following description illustrate specific exemplary embodiments. It will thus be appreciated that those skilled in the art will be able to devise various arrangements that, although not explicitly described or shown herein, embody the principles of the embodiments and are included within the scope of the embodiments. Furthermore, any examples described herein are intended to aid in understanding the principles of the embodiments, and are to be construed as being without limitation to such specifically recited examples and conditions. As a result, the inventive concept(s) is not limited to the specific embodiments or examples described below, but by the claims and their equivalents.

Figure 1:
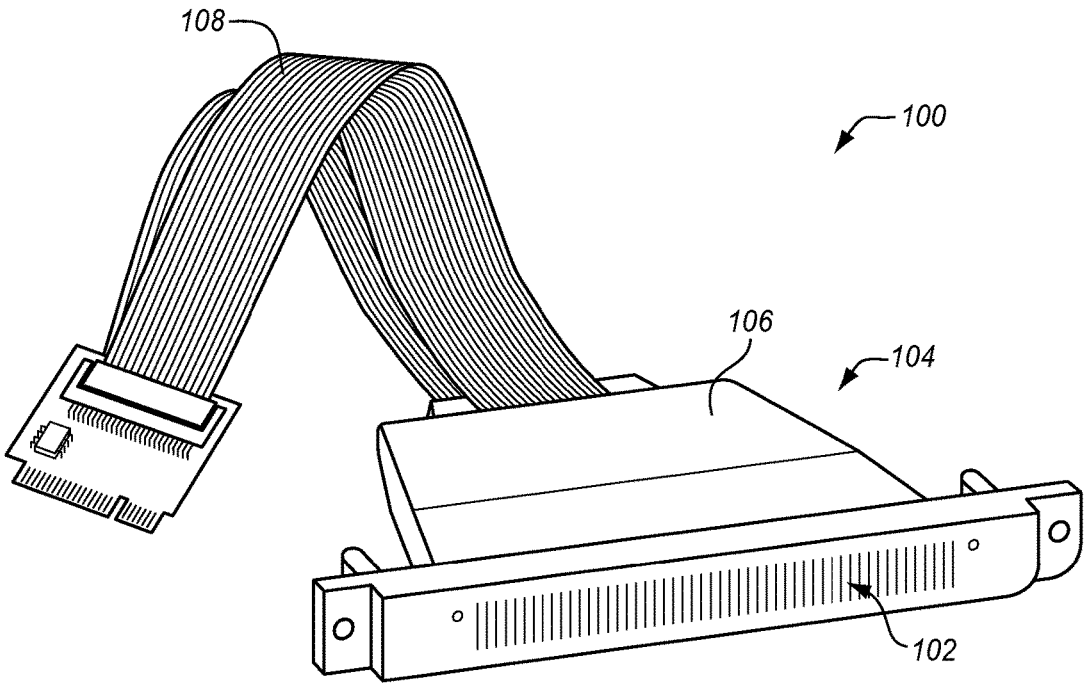
FIG. 1 illustrates an inkjet head.

FIG. 1 illustrates an inkjet head 100. Inkjet head 100 includes a nozzle surface 102 with one or more rows of nozzles that jet or eject droplets of a print fluid, such as ink (e.g., water, solvent, oil, or UV-curable). Opposite the nozzle surface 102 is the side of inkjet head 100 used for input/output (I/O) of the print fluid, electronic signals, etc. This side of inkjet head 100 is referred to as the I/O side 104. I/O side 104 includes electronics 106 that connect to a data source through cabling 108. Electronics 106 control how the nozzles of inkjet head 100 jet droplets of ink. Although the term "ink" is used herein, inkjet head 100 is capable of dispersing different types of print fluids. Therefore, inkjet head 100 may also be referred to generally as a print head.

Figure 2:
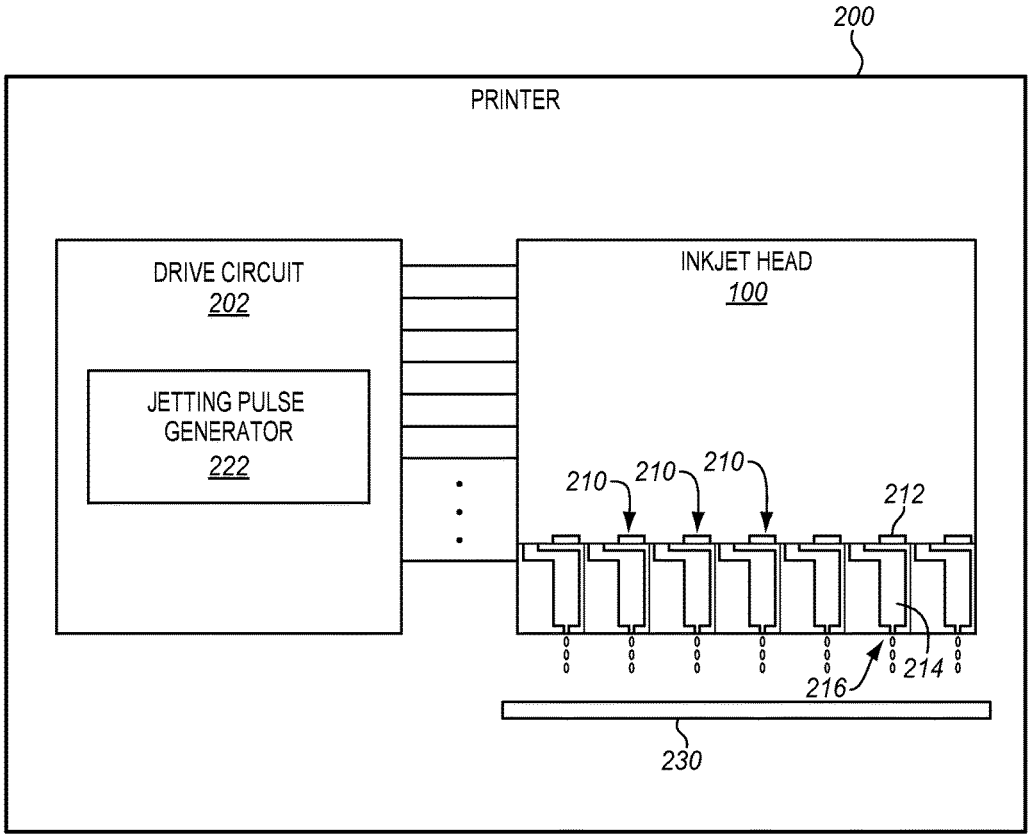
FIG. 2 is a schematic diagram of an inkjet printer.

FIG. 2 is a schematic diagram of an inkjet printer 200. Printer 200 includes inkjet head 100, and a drive circuit 202 for providing drive waveforms to inkjet head 100. Inkjet head 100 includes multiple ink channels 210 in parallel, a portion of which are illustrated in FIG. 2. Each ink channel 210 includes a piezoelectric actuator 212, a chamber 214 (i.e., a pressure chamber), and a nozzle 216 (also referred to as a "jet"). Piezoelectric actuators 212 are configured to receive jetting pulses, and to actuate or "fire" in response to jetting pulses. The drive waveform of the jetting pulses is optimized to meet requirements of the jetting application and also to reduce unwanted pressure waves within chamber 214. Firing of a piezoelectric actuator 212 in an ink channel 210 creates a positive pressure pulse that causes jetting of droplets from nozzles 216 at a desired direction, weight, velocity, and shape.

Drive circuit 202 generates the jetting pulses for piezoelectric actuators 212, where the jetting pulses have an optimized drive waveform. A "jetting pulse" is defined as a pulse that causes a droplet to be jetted from an ink channel 210. Drive circuit 202 includes a jetting pulse generator 222 that is configured to selectively provide the jetting pulses to ink channels 210 to discharge ink onto a medium 230. A medium as described herein comprises any type of material upon which ink or another print fluid is applied by an inkjet head for printing, such as paper, a substrate for 3D printing, cloth, etc. Jetting pulse generator 222 is triggered at time intervals of 1/Fmax, such as from an encoder strip, creating trigger pulses as inkjet head 100 traverses across medium 230. This is achieved by having the head traversing speed across medium 230 set to equal minimum dot-to-dot spacing (resolution) multiplied by Fmax. Jet firing may include both an encoder pulse trigger and an image print requirement.

Nozzles 216 or "jets" of inkjet head 100 are able to fire at a maximum jetting frequency, which is the frequency of the jetting pulses on the drive waveform. After droplet ejection from a nozzle 216 of an ink channel 210, the pressure waves resonate within the ink channel 210. It may take several microseconds for the pressure waves to dampen or be clamped so that the next droplet can be jetted from that ink channel 210. Therefore, the maximum frequency used for jetting in inkjet head 100 is limited. Previously, the maximum jetting frequency (Fmax) was determined by firing the jets of the inkjet head on a test stand at a constant frequency, and measuring drop velocity and/or drop mass. The frequency applied to the inkjet head was slowly increased until one or more of the jets failed. The frequency where jets of the inkjet head show failure was taken as Fmax for that inkjet head.

New laboratory experiments and simulations have shown that there is not just one maximum frequency above which the jet will fail but rather a series of frequency zones inside of which jet failure may occur but, outside of the zones, jetting will be failure free. In earlier laboratory experiments, frequency was increased slowly so that jetting at a failure frequency would continue for some time before failure would occur. Once a jet has undergone failure, it frequently ingests air or results in small quantities of ink being deposited on the outside surface of the nozzle plate. Both of these conditions have to be addressed successfully before the jet can be fired again. The common remedies of re-priming and/or wiping the nozzle plate are often not sufficient to fully restore jet stability.

Figure 6:
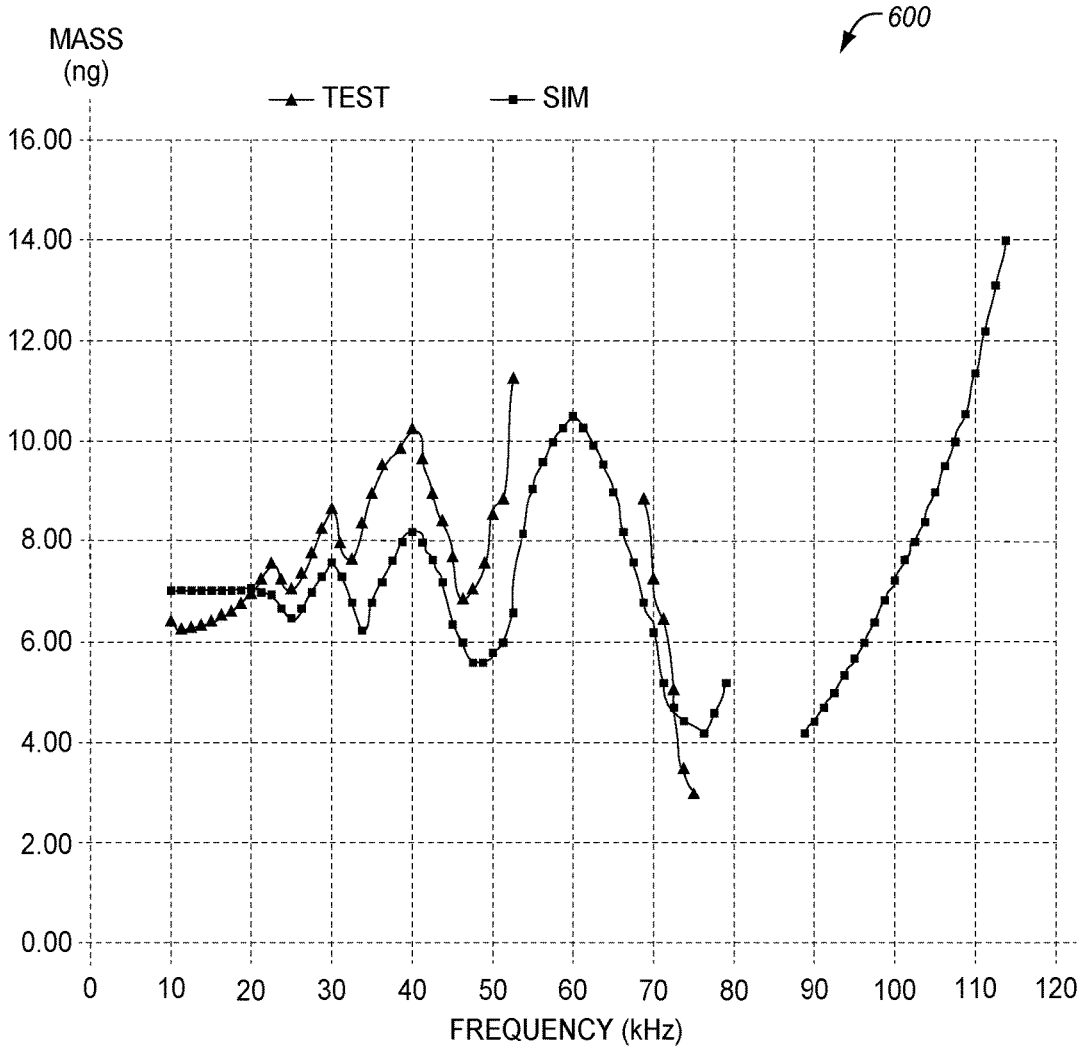
FIG. 6 illustrates a mass/frequency curve in an exemplary embodiment.
Figure 7:
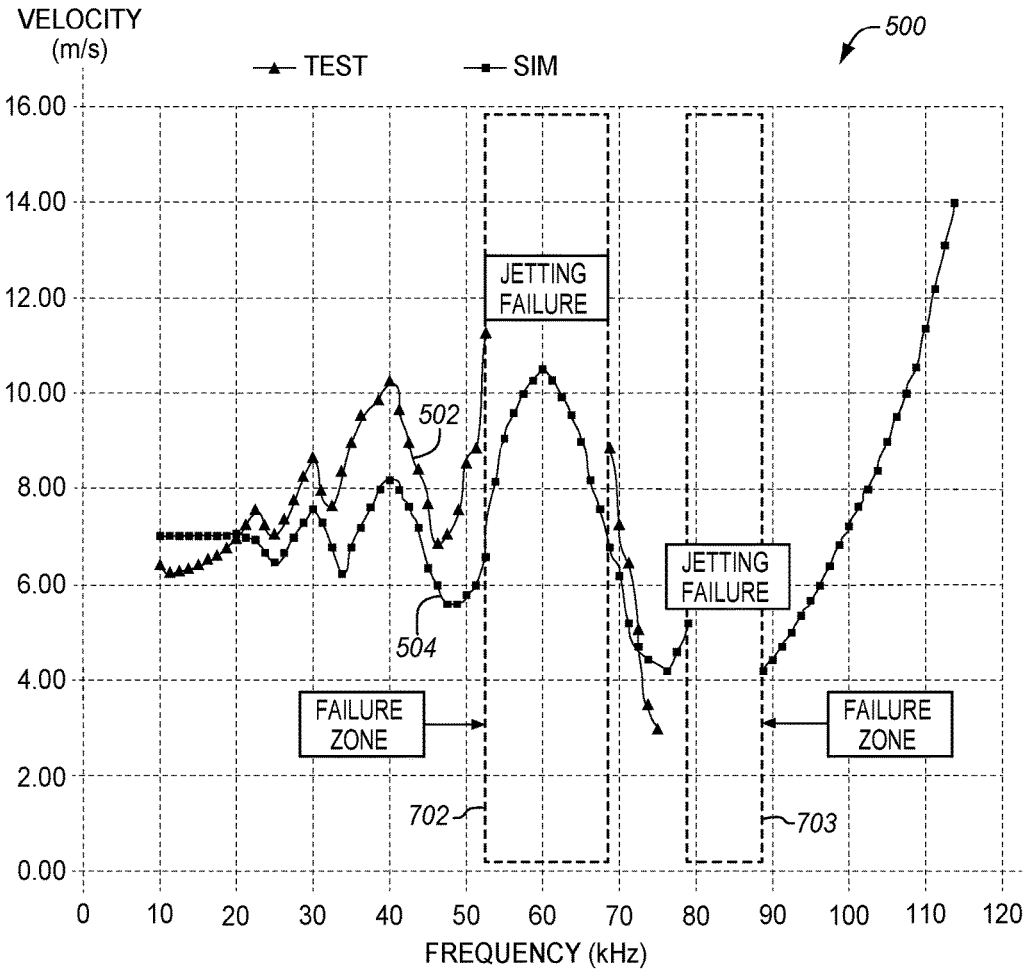
FIG. 7 illustrates failure zones in a velocity/frequency curve in an exemplary embodiment.

Simulations and more recent experiments have shown that failure zones occur usually at higher frequencies around the higher peaks and valleys of the velocity/drop size frequency curve (see FIGS. 6-7). The failures at the valleys occur because the drop velocity has fallen below the stable operating range. The failures at the peaks result possibly from ligament break-up or de-prime caused by high ink flow rates through the restrictor. Around peak frequencies, simulations have shown continuing Helmholtz pressure oscillations in the chamber high enough in amplitude to emit one or more spurious small drops following the firing of the main drop.

All of these types of jet failure mechanisms would not be expected to cause immediate failure but would eventually cause failure after a period of continuous jetting for some time at the failure frequency. This is consistent with experimental observations. It can therefore be concluded that the old method of determining the maximum operating frequency is unnecessarily restrictive. An Fmax can be selected at any frequency outside of failure zones. Moreover, the jet on a printer is not required to operate at all frequencies below Fmax. Fmax operation is used such as when the printer calls for jetting at every possible time signaled by an encoder strip as the head is scanned across a print medium. The next highest frequency is when printing is required at every other encoder time signal. Required frequencies will therefore lie in the series Fmax, Fmax/2, Fmax/3, . . . Fmax can therefore be selected with the aid of FIGS. 6-7 so that all sub-multiples of Fmax fall outside of any failure zones.

When using an optimal combination of drive waveform, restrictor size, and orifice size, the failure zones are more limited. Therefore, under these conditions, the range of Fmax so that all Fmax sub-multiples fall outside the failure zones becomes wider. This opens up the possibility of selecting Fmax not just to obtain the maximum frequency possible but also to minimize variations in drop velocity/volume over the whole frequency range (all Fmax sub-multiples).

Figure 3:
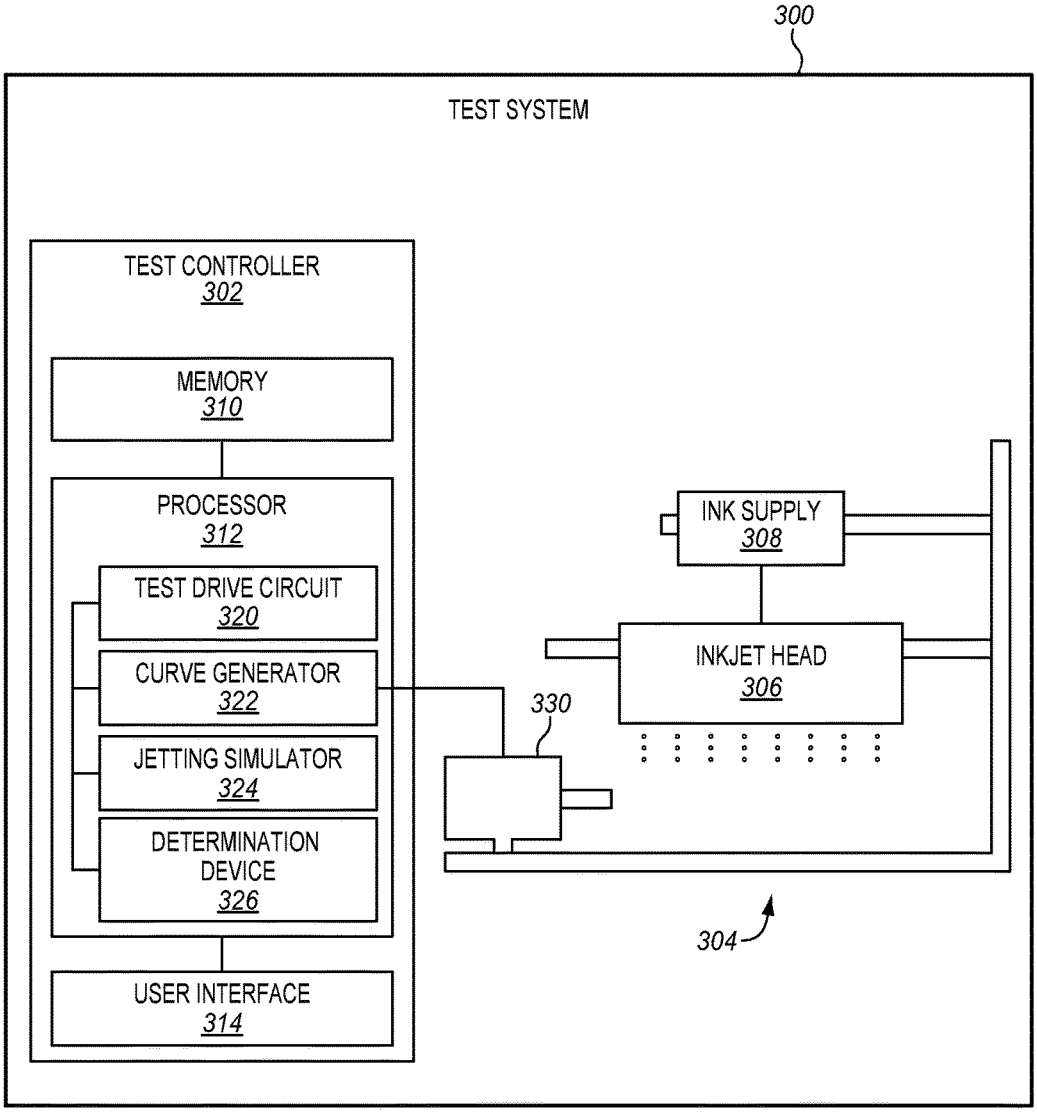
FIG. 3 is a schematic diagram of a test system in an exemplary embodiment.

The embodiments described herein provide for improved ways of determining Fmax for an inkjet head, such as inkjet head 100. FIG. 3 is a schematic diagram of a test system 300 in an exemplary embodiment. Test system 300 is configured to determine an optimal Fmax for an inkjet head, and includes a test controller 302 and a test stand 304. Test stand 304 secures an inkjet head 306 that is being evaluated. Test stand 304 includes an ink supply 308 that supplies ink (or another print fluid) to inkjet head 306 for the tests. Test controller 302 is configured to perform an analysis on the performance of inkjet head 306 to determine the optimal Fmax for inkjet head 306.

Test controller 302 comprises a hardware platform that includes a memory 310, a processor 312, and a user interface 314. Memory 310 comprises any device that stores data, such as instructions that are executable by processor 312. Processor 312 is a hardware device that comprises logic circuitry for responding to and processing the instructions that drive test controller 302. User interface 314 comprises a device that allows a user to interact with test controller 302. User interface 314 may include an input mechanism, such as a keypad, touch screen, mouse, microphone, etc. User interface 314 may also include an output mechanism, such as a display, a speaker, etc. Processor 312 implements a test drive circuit 320, a curve generator 322, jetting simulator 324, and a determination device 326. Test drive circuit 320 is configured to generate drive waveforms for inkjet head 306 for the analysis. For example, test drive circuit 320 may apply drive waveforms to inkjet head 306 having a constant frequency for a time interval (or a certain number of drops), and then increase the frequency after the time interval up to a maximum possible frequency attainable by inkjet head 306. Curve generator 322 is configured to generate a velocity/frequency curve for inkjet head 306, and/or generate a mass/frequency curve for inkjet head 306. Curve generator 322 may communicate with a droplet analyzer 330 to obtain data about the actual jetting characteristics of inkjet head 306 for generating the velocity/frequency curve or the mass/frequency curve. Droplet analyzer 330 comprises a device that is able to detect jetting characteristics of the droplets ejected from inkjet head 306. Droplet analyzer 330 may have different configurations in different embodiments. In one embodiment, droplet analyzer 330 may include a device that uses a visualization technique to analyze actual droplet jetting/ejection of inkjet head 306. For example, a stroboscopic visualization technique may be used, which uses a high-resolution camera, a Laser Doppler Velocimetry (LDV) system, and a stroboscope to analyze droplet jetting from nozzles of inkjet head 306. A visualization technique such as this may be used to measure the velocity and mass of droplets that are jetted from nozzles of inkjet head 306. Curve generator 322 may also communicate with jetting simulator 324. Jetting simulator 324 may use a modeling technique (e.g., Lumped Element Modeling (LEM)) to simulate droplet jetting/ejection of inkjet head 306. The LEM is a mathematical model of a single inkjet channel comprising coupled equations of motion of the various elements of the channel, such as the nozzle, restrictor, pressure chamber, diaphragm, and piezoelectric element. The motions are assumed one dimensional. Each element is represented by its fluidic parameters of inertance, compliance, and resistance. Inputs to the model include the specific dimensions of the elements, physical properties of the fluid and piezoelectric element, and parameters that define the shape and voltage of the drive waveform applied to the piezoelectric element. The frequency is set by repeating the application of the drive waveform at a period corresponding to that of the desired frequency for a fixed predetermined number of repetitions. A computer program is used to integrate the set of non-linear differential equations, calculate drop volume and average velocity at each frequency, as well as volume displacements of moving elements of the model in real time.

Determination device 326 is configured to analyze the velocity/frequency curve and/or the mass/frequency curve generated for inkjet head 306, and to select an Fmax for inkjet head 306 from one or both of the curves. As is described in more detail below, determination device 326 may evaluate the velocity/frequency curve and/or the mass/frequency curve, and select an Fmax subject to the condition that each of the subharmonics of Fmax (i.e., Fmax/1, Fmax/2, Fmax/3, Fmax/4, . . . ) lies outside of failure zones identified in the curves.

Figure 4:
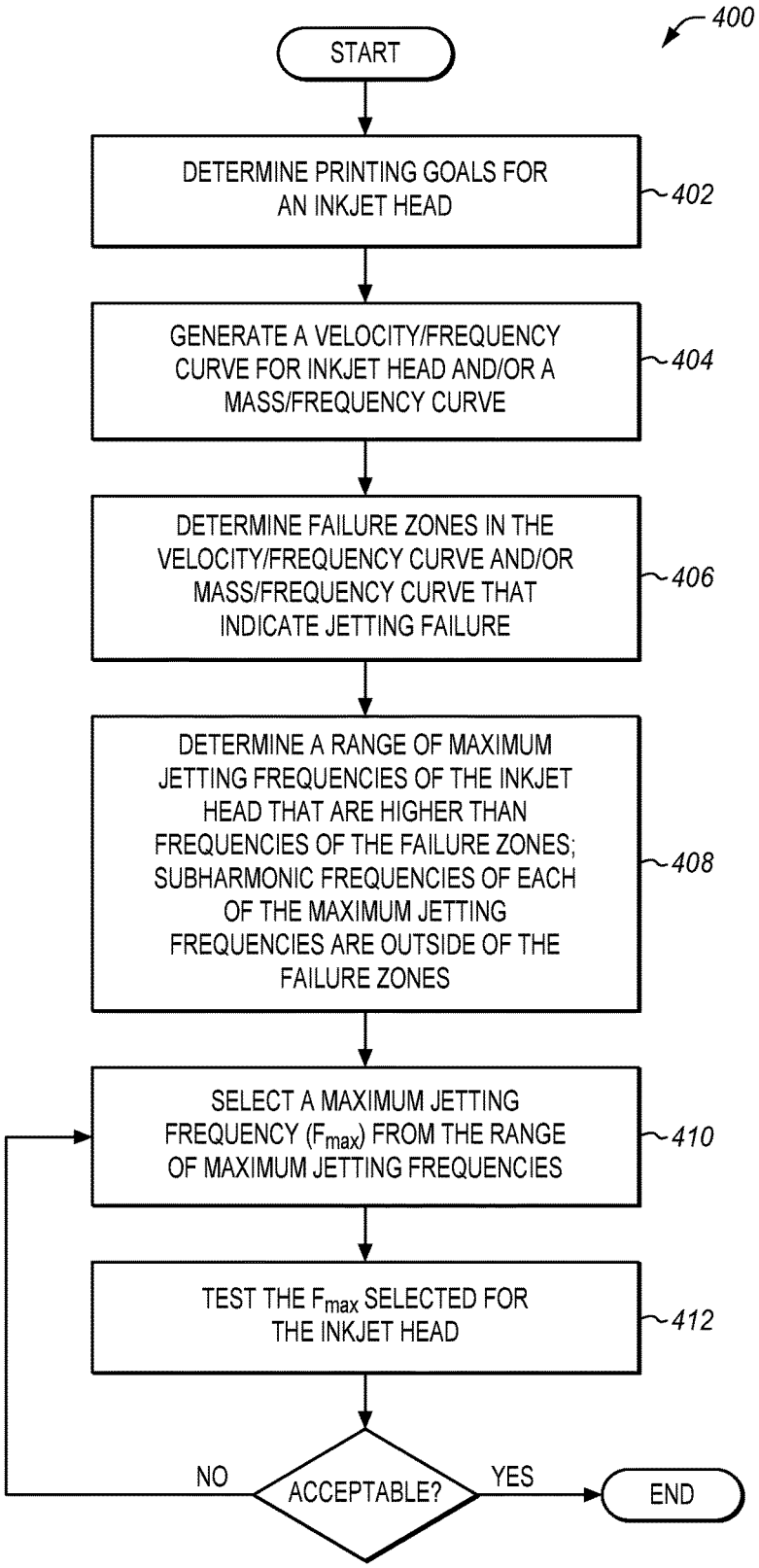
FIG. 4 is a flow chart illustrating a method of determining Fmax for an inkjet head in an exemplary embodiment.

FIG. 4 is a flow chart illustrating a method 400 of determining Fmax for an inkjet head in an exemplary embodiment. The steps of method 400 will be described with respect to test system 300 in FIG. 3, although one skilled in the art will understand that the methods described herein may be performed by other devices or systems not shown. The steps of the methods described herein are not all inclusive and may include other steps not shown.

Test controller 302 determines printing goals for inkjet head 306 (step 402). For example, a user may enter printing goals, such as maximum possible frequency for a drive waveform, a minimum velocity spread, a minimum mass spread, a minimum dot placement spread, etc., through user interface 314. The maximum possible frequency may be the Helmholtz frequency (H) of inkjet head 306. Within the pressure chambers of inkjet head 306, pressure waves will resonate or absorb at a characteristic frequency. This characteristic frequency is determined by the geometry of the pressure chambers (and other structures of an ink channel) and their associated fluidic properties, which is referred to as the Helmholtz frequency or Helmholtz resonance frequency.

The minimum velocity spread comprises a minimum difference of velocity across subharmonic frequencies of a range of maximum jetting frequencies (e.g., $Fmax_1$–$Fmax_n$). Subharmonic frequencies are frequencies of an Fmax in a ratio of 1/n, where n is a positive integer number. For example, the subharmonic frequencies or subharmonic series of $Fmax_1$ are $Fmax_1/1$, $Fmax_1/2$, $Fmax_1/3$, $Fmax_1/4$, etc. The minimum velocity spread indicates a minimum difference of droplet velocity across the subharmonic frequencies of the range of maximum jetting frequencies. For example, if $Fmax_1/2$ results in a droplet velocity of 5.47 m/s and $Fmax_1/3$ results in a droplet velocity of 7.07 m/s, then the velocity spread between these two subharmonics is 1.6 m/s. The smallest velocity spread among the range of maximum jetting frequencies (e.g., $Fmax_1$–$Fmax_n$) is the minimum velocity spread.

The minimum mass spread comprises a minimum difference of droplet mass or weight across subharmonic frequencies of a range of maximum jetting frequencies (e.g., $Fmax_1$–$Fmax_n$). For example, if $Fmax_1/2$ results in a droplet mass of 4.8 nanograms (ng) and $Fmax_1/3$ results in a droplet mass of 6.3 ng, then the mass spread between these two subharmonics is 1.5 ng. The smallest mass spread among the range of maximum jetting frequencies (e.g., $Fmax_1$–$Fmax_n$) is the minimum mass spread.

The minimum dot placement spread comprises a minimum distance between dots produced by droplets on a medium across the subharmonic frequencies of an Fmax. An estimation of dot placement spread is described in more detail below.

Figure 5:
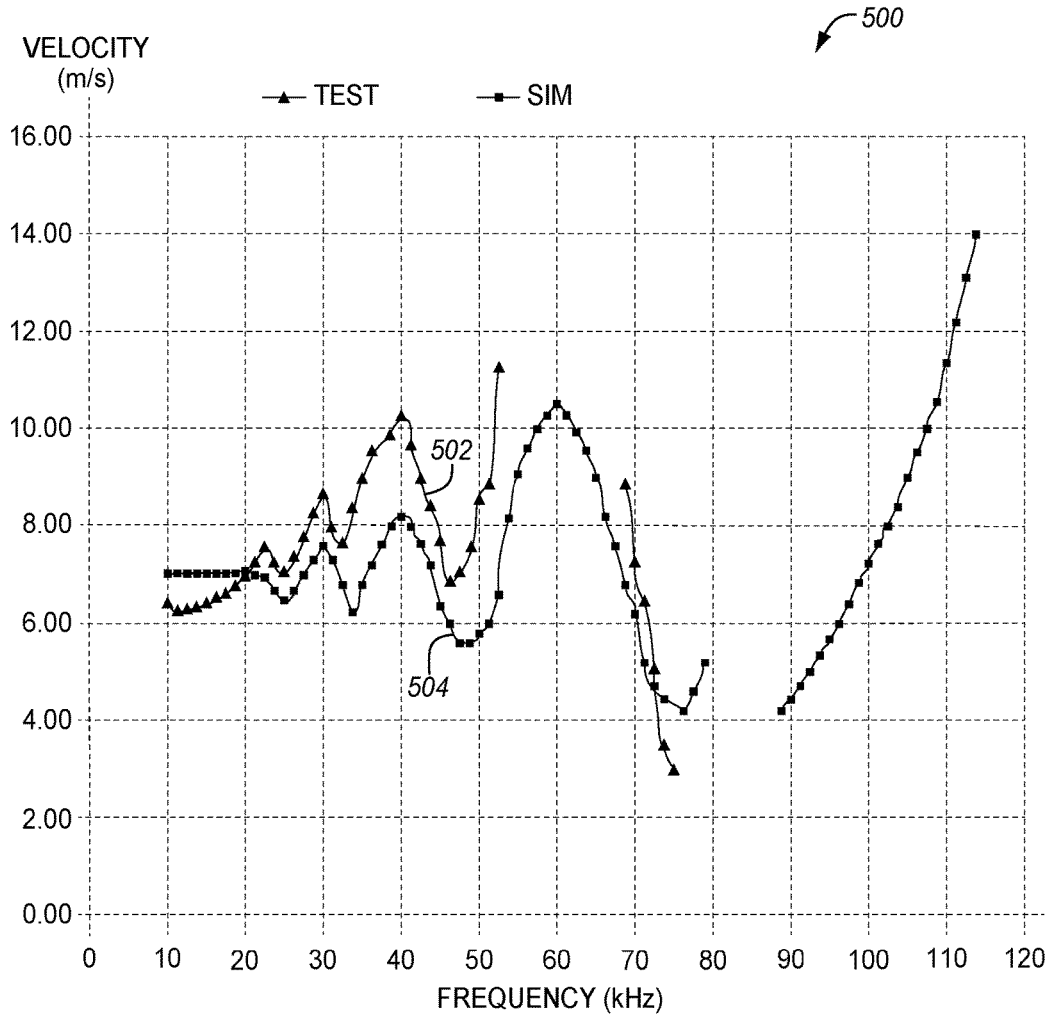
FIG. 5 illustrates a velocity/frequency curve in an exemplary embodiment.

Curve generator 322 of test controller 302 generates a velocity/frequency curve for inkjet head 306 (step 404). A velocity/frequency curve indicates a relationship between the velocity of droplets jetted from an inkjet head, and the frequency of a drive waveform applied to the inkjet head. FIG. 5 illustrates a velocity/frequency curve 500 in an exemplary embodiment. The vertical axis in FIG. 5 represents the velocity of a droplet, and the horizontal axis represents the frequency of the drive waveform. Two lines are illustrated for velocity/frequency curve 500. One line 502 illustrates data plotted for an actual test of inkjet head 306 (i.e., from droplet analyzer 330). To plot line 502 in one embodiment, curve generator 322 may control tests on inkjet head 306 while on test stand 304. Ink supply 308 supplies a print fluid to inkjet head 306, and test drive circuit 320 supplies a drive waveform for driving inkjet head 306 having a specific voltage and specific shape. Inkjet head 306 will eject droplets from one or more of its nozzles based on the drive waveform. Droplet analyzer 330 then measures the drop velocity of inkjet head 306 over a set of increasing frequencies. The data from these tests may then be plotted as line 502 on velocity/frequency curve 500. The values of the data plotted in the graphs provided here are exemplary, and may vary depending on the inkjet head being analyzed.

The other line 504 in FIG. 5 illustrates data plotted from a simulation of inkjet head 306. To plot line 504 in another embodiment, curve generator 322 may instruct jetting simulator 324 to simulate jetting of inkjet head 306 over a set of increasing frequencies. Data from the simulation may be plotted as line 504 on velocity/frequency curve 500. A combination of actual testing and simulation may be used to generate the velocity/frequency curve 500 for inkjet head 306.

Curve generator 322 may additionally or alternatively perform tests on inkjet head 306 to generate a mass/frequency curve in step 404. FIG. 6 illustrates a mass/frequency curve 600 in an exemplary embodiment. As above, curve generator 322 may use actual testing and/or simulation to generate the mass/frequency curve 600 for inkjet head 306.

Determination device 326 determines or identifies failure zones in the velocity/frequency curve 500 that indicate jetting failure (step 406). A failure zone is a frequency span in velocity/frequency curve 500 resulting in jetting failure in inkjet head 306. In a typical inkjet head, an operator expects to see predictable and repeatable velocity at a given frequency. As the frequency of the drive waveform is increased, such as in testing, a typical inkjet head will experience unpredictable behavior resulting in formation of satellites, formation of multiple droplets, neck elongation during droplet formation, non-jetting, etc., which represent a jetting failure. Determination device 326 is able to process velocity/frequency curve 500 to identify the failure zones. FIG. 7 illustrates failure zones in velocity/frequency curve 500 in an exemplary embodiment. As is evident in line 502, jetting failure was found in testing in a frequency span of about 53 kHz-68 kHz and above 75 kHz. In line 504, jetting failure was found in simulation in a frequency span of about 78 kHz-88 kHz. These regions of jetting failure represent failure zones 702-703 that is identified by determination device 326. In the example shown in FIG. 7, determination device 326 may determine failure zone 702 at, around, or proximate to H/2, and determine failure zone 703 at, around, or proximate to 2H/3.

In step 406, determination device 326 may additionally or alternatively determine failure zones in the mass/frequency curve 600 that indicate jetting failure. The failure zones may again be around H/2 and 2H/3.

Determination device 326 then determines a range of maximum jetting frequencies (e.g., $Fmax_1$–$Fmax_n$) of inkjet head 306 (step 408). The range of maximum jetting frequencies is above the failure zones 702-703. Also, subharmonic frequencies of each of the maximum jetting frequencies are outside of the failure zones 702-703. For example, $Fmax_1$, $Fmax_2$, . . . $Fmax_n$, are each at a higher frequency than the failure zones 702-703. Also, in the range of maximum jetting frequencies, subharmonic frequencies of each of the maximum jetting frequencies are outside of the failure zones. For example, $Fmax_1$, $Fmax_1/2$, $Fmax_1/3$, . . . , each lie outside of the failure zones 702-703, $Fmax_2$, $Fmax_2/2$, $Fmax_2/3$, . . . , each lie outside of the failure zones 702-703, and $Fmax_n$, $Fmax_n/2$, $Fmax_n/3$, . . . , each lie outside of the failure zones 702-703.

Figure 8:
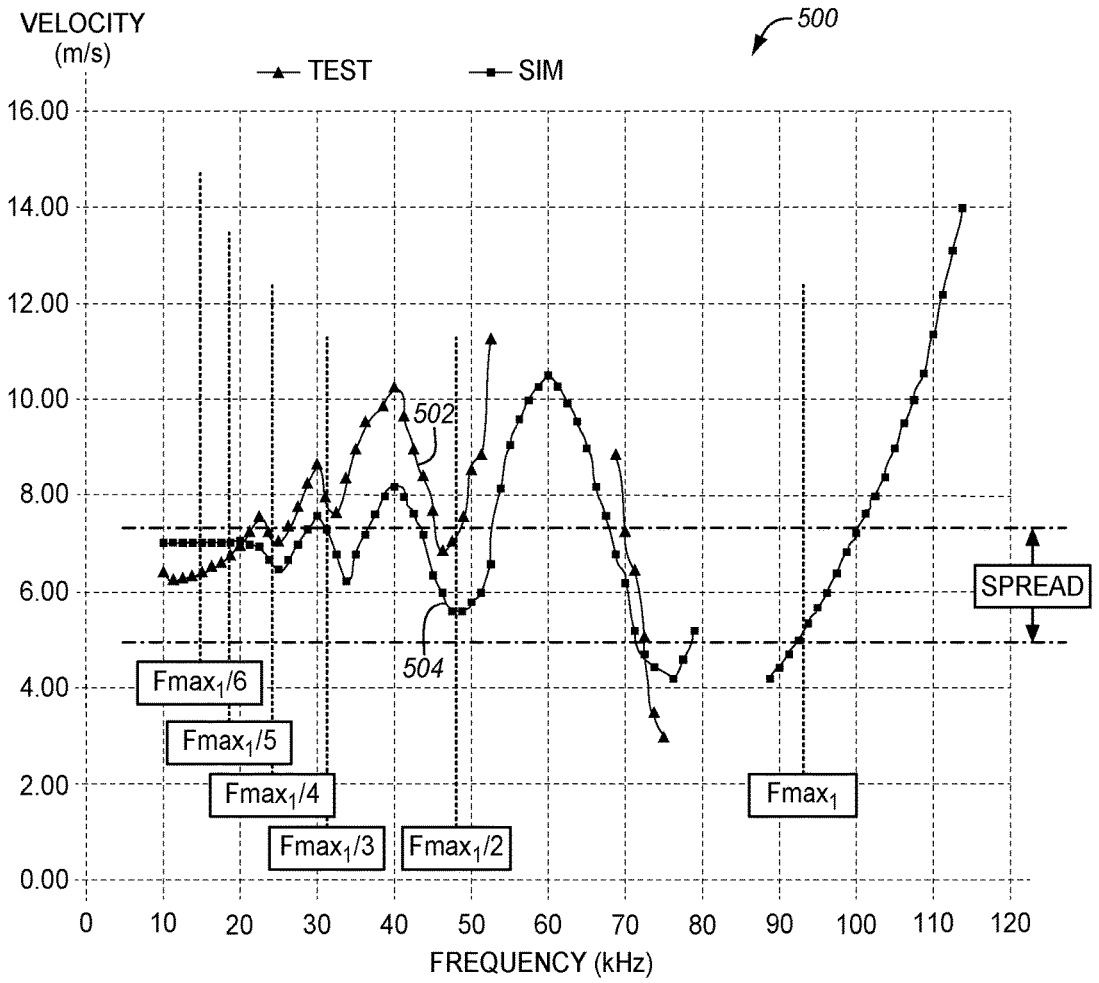
FIG. 8 illustrates a velocity spread in a velocity/frequency curve in an exemplary embodiment.

Determination device 326 selects a maximum jetting frequency (Fmax) from the range of maximum jetting frequencies (step 410). In one embodiment, determination device 326 may select a highest frequency in the range of maximum jetting frequencies as Fmax. In another embodiment, determination device 326 may select Fmax from the range of maximum jetting frequencies that results in a minimum velocity spread across its subharmonic frequencies. FIG. 8 illustrates a velocity spread in velocity/frequency curve 500 in an exemplary embodiment. Assume that $Fmax_1$ in the range of maximum jetting frequencies is at about 93 kHz. FIG. 8 illustrates the subharmonics of $Fmax_1$. Determination device 326 identifies the maximum difference between the velocities (i.e., the velocity spread) across the subharmonic series of $Fmax_1$, which is between $Fmax_1$ and $Fmax_1/3$ in this example. Determination device 326 identifies the velocity spread for each frequency in the range of maximum jetting frequencies ($Fmax_1$–$Fmax_n$), and selects Fmax from the range of maximum jetting frequencies ($Fmax_1$–$Fmax_n$) that has the smallest velocity spread across its subharmonic series. Determination device 326 may alternatively select Fmax from the range of maximum jetting frequencies that results in a minimum mass spread across the subharmonic frequencies in a similar manner.

Figure 9:
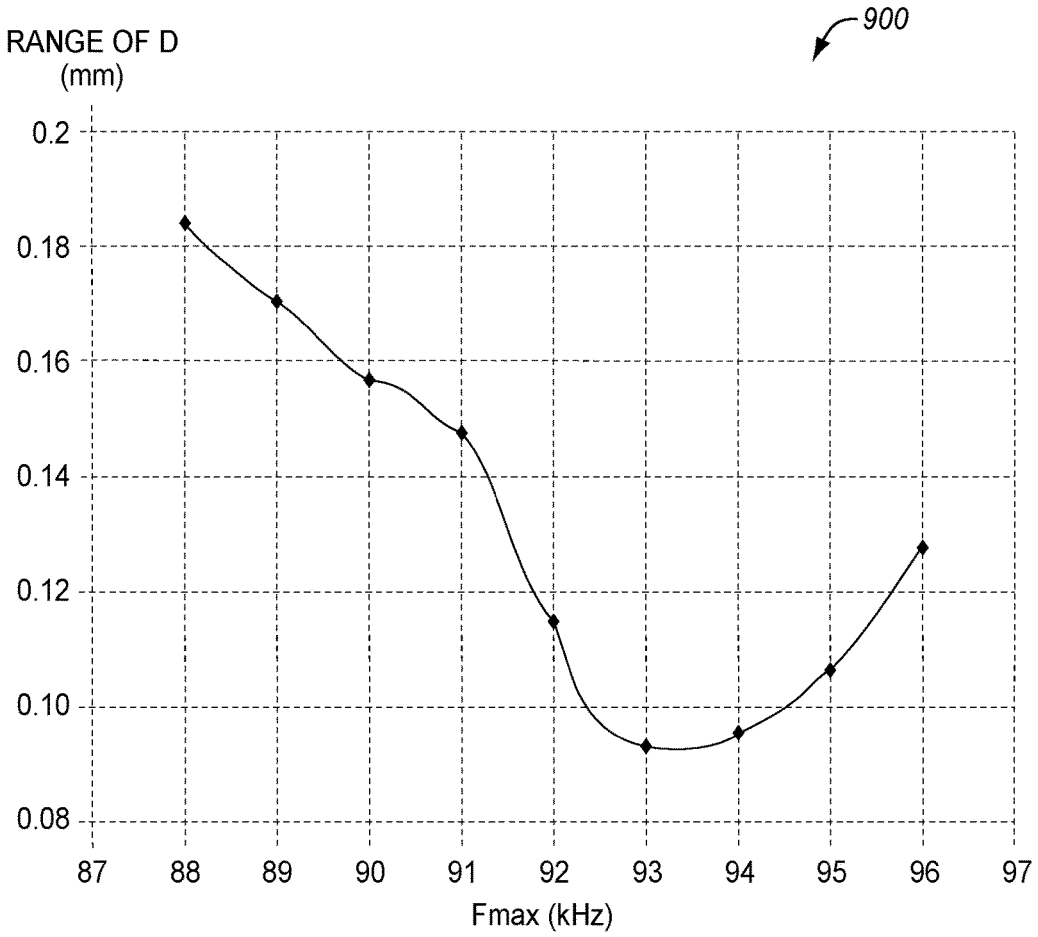
FIG. 9 illustrates a dot placement curve in an exemplary embodiment.

In another embodiment, determination device 326 may select Fmax from the range of maximum jetting frequencies that results in a minimum drop placement spread across the subharmonic frequencies. Dot placement deviation can be expressed by a spherical drop landing on a moving substrate (speed, S) after traversing a gap (G) at a velocity (V). If the velocity is assumed to be 7 m/s, the 7 m/s dot position may be used as a point of reference where dot deviation is defined as D=0. For velocities lower than 7 m/s, the drop will reach the substrate later and the dot will lag the zero position by an amount $D=SG(7-V)/7V$. For $V<7$, D is positive and represents a deviation in dot position in the direction of printing (for $V<7$, $D\rightarrow\infty$ as $V\rightarrow 0$). For $V>7$, D is negative and represents a dot deviation in the opposite direction. In this case, there is a limit upon how large D can become (for $V>7$, $D\rightarrow -SG/7$ as $V\rightarrow\infty$). Thus, a low V has a stronger impact on D than high V. If constant values are assigned to S and G, the dot placement spread across the subharmonic series of an Fmax may be determined using the velocities of the droplets at these subharmonic frequencies. For example, a value of 2 m/s may be selected for S, and a value of 1 mm may be selected for G. Substituting these numbers, D=2(7−V)/7V, where D is in mm. With the dot placement (D) plotted for each subharmonic frequency, the dot placement spread may be determined. FIG. 9 illustrates a dot placement curve 900 in an exemplary embodiment. The vertical axis in FIG. 9 represents the dot placement deviation, and the horizontal axis represents the range of maximum jetting frequencies. The range illustrated in FIG. 9 is between 87-97 kHz in this example. As is illustrated in dot placement curve 900, the smallest dot placement occurs at about 93 kHz (<0.1 mm). Therefore, determination device 326 may select an Fmax of about 93 kHz from the range of 87 kHz to 97 kHz.

Test controller 302 may then test the Fmax selected for inkjet head 306 (step 412). For example, test controller 302 may control tests on inkjet head 306 and/or simulation of inkjet head 306 at Fmax. If Fmax is not acceptable, then determination device 326 returns to step 410 and selects an adjusted Fmax from the range of maximum jetting frequencies. This process repeats until an acceptable Fmax is selected from the range of maximum jetting frequencies. If Fmax is acceptable, then method 400 ends. A printer that uses inkjet head 306 (or a similar model of inkjet head 306) may then be set to a scan speed based on the Fmax and a desired print resolution.

Figure 10:
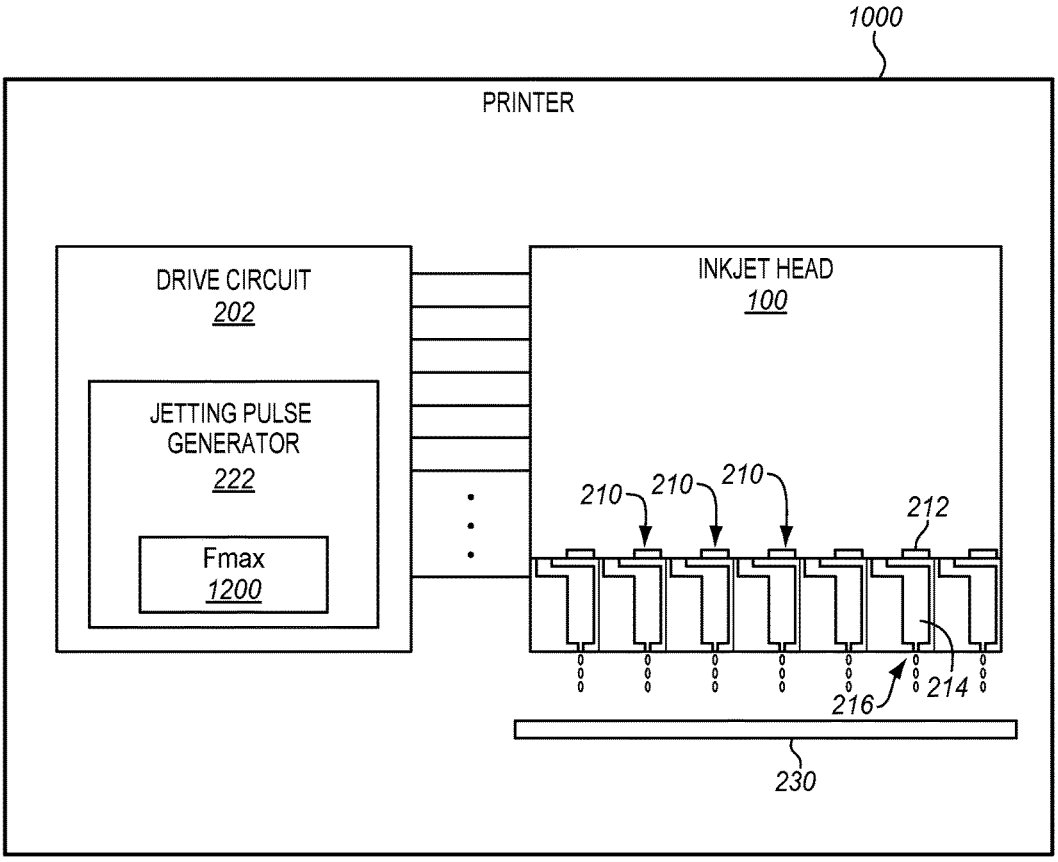
FIG. 10 illustrates a printer that uses an Fmax in an exemplary embodiment.

FIG. 10 illustrates a printer 1000 that uses an Fmax in an exemplary embodiment. Printer 1000 resembles printer 200 in FIG. 2, except that jetting pulse generator 222 is programmed or set to operate at the Fmax 1200 selected according to method 400. Therefore, the jetting pulses on the drive waveform are at the maximum jetting frequency (Fmax 1200) selected for inkjet head 100, which is above the failure zones 702-703 (see FIG. 7). In other words, Fmax 1200 is at a higher frequency than the failure zones 702-703. Also, the subharmonic frequencies of Fmax 1200 are outside of the failure zones 702-703. For example, Fmax/2, Fmax/3, . . . , each lie outside of the failure zones 702-703. Therefore, printer 1000 is advantageously able to print at higher speeds as compared to prior printers.

Fmax, as selected in method 400, is greater than a failure frequency where inkjet head 306 initially experiences jetting failure (i.e., a nozzle fails to jet, drop velocity falls below a threshold, drop mass falls below a threshold, etc.). As stated above, Fmax was previously determined by increasing the frequency until one or more jets fail. The failure frequency (i.e., the frequency where one or more jets fail) was previously used as Fmax. In FIG. 5 for example, line 502 shows a test of inkjet head 306 where jetting failure occurs at about 53 kHz. Previously, this frequency may have been selected as Fmax for inkjet head 306. However, further testing shows that inkjet head 306 recovers at about 68 kHz. Also, simulation shows that inkjet head 306 recovers above about 88 kHz. According to method 400, determination device 326 advantageously selects an Fmax that is greater than the failure frequency where inkjet head 306 initially fails. Thus, a higher Fmax may be selected for inkjet head 306 than was previously considered, which allows for faster printing speeds. Also, method 400 ensures that the subharmonics of this higher Fmax lie outside of the failure zones so that inkjet head 306 may be used at any of the subharmonics in an effective manner.

Any of the various elements or modules shown in the figures or described herein may be implemented as hardware, software, firmware, or some combination of these. For example, an element may be implemented as dedicated hardware. Dedicated hardware elements may be referred to as "processors", "controllers", or some similar terminology. When provided by a processor, the functions may be provided by a single dedicated processor, by a single shared processor, or by a plurality of individual processors, some of which may be shared. Moreover, explicit use of the term "processor" or "controller" should not be construed to refer exclusively to hardware capable of executing software, and may implicitly include, without limitation, digital signal processor (DSP) hardware, a network processor, application specific integrated circuit (ASIC) or other circuitry, field programmable gate array (FPGA), read only memory (ROM) for storing software, random access memory (RAM), non-volatile storage, logic, or some other physical hardware component or module.

Also, an element may be implemented as instructions executable by a processor or a computer to perform the functions of the element. Some examples of instructions are software, program code, and firmware. The instructions are operational when executed by the processor to direct the processor to perform the functions of the element. The instructions may be stored on storage devices that are readable by the processor. Some examples of the storage devices are digital or solid-state memories, magnetic storage media such as a magnetic disks and magnetic tapes, hard drives, or optically readable digital data storage media.

Although specific embodiments were described herein, the scope of the invention is not limited to those specific embodiments. The scope of the invention is defined by the following claims and any equivalents thereof.

What is claimed is:

1. A method comprising:

generating a velocity/frequency curve for an inkjet head;

determining failure zones in the velocity/frequency curve that comprise frequencies in the velocity/frequency curve resulting in jetting failure of the inkjet head;

determining a range of maximum jetting frequencies of the inkjet head that are higher than the frequencies of the failure zones, wherein subharmonic frequencies of each of the maximum jetting frequencies are outside of the failure zones; and selecting a maximum jetting frequency for the inkjet head from the range of maximum jetting frequencies.

2. The method of claim 1 wherein selecting a maximum jetting frequency from the range of maximum jetting frequencies comprises:

selecting a highest frequency in the range of maximum jetting frequencies as the maximum jetting frequency.

3. The method of claim 1 wherein selecting a maximum jetting frequency from the range of maximum jetting frequencies comprises:

selecting the maximum jetting frequency from the range of maximum jetting frequencies that results in a minimum velocity spread across the subharmonic frequencies.

4. The method of claim 1 wherein selecting a maximum jetting frequency from the range of maximum jetting frequencies comprises:

selecting the maximum jetting frequency from the range of maximum jetting frequencies that results in a minimum drop placement spread across the subharmonic frequencies.

5. The method of claim 1 further comprising:

determining a mass/frequency curve for the inkjet head; and determining the failure zones in the mass/frequency curve.

6. The method of claim 1 wherein generating the velocity/frequency curve comprises:

supplying a print fluid to the inkjet head;

supplying a drive waveform for driving the inkjet head; and measuring drop velocity of the inkjet head over a set of increasing frequencies in the drive waveform.

7. The method of claim 1 wherein generating the velocity/frequency curve comprises:

simulating jetting of the inkjet head over a set of increasing frequencies.

8. The method of claim 1 wherein determining the failure zones in the velocity/frequency curve comprises:

determining a Helmholtz frequency (H) of the inkjet head;

determining a first one of the failure zones around H/2; and determining a second one of the failure zones around 2H/3.

9. A test system for determining a maximum jetting frequency for an inkjet head, the test system comprising:

a test controller comprising:

a curve generator that generates a velocity/frequency curve for the inkjet head; and a determination device that determines failure zones in the velocity/frequency curve that comprise frequencies in the velocity/frequency curve resulting in jetting failure of the inkjet head, and determines a range of maximum jetting frequencies of the inkjet head that are higher than the frequencies of the failure zones, wherein subharmonic frequencies of each of the maximum jetting frequencies are outside of the failure zones;

the determination device selects the maximum jetting frequency for the inkjet head from the range of maximum jetting frequencies.

10. The test system of claim 9 wherein:

the determination device selects a highest frequency in the range of maximum jetting frequencies as the maximum jetting frequency.

11. The test system of claim 9 wherein:

the determination device selects the maximum jetting frequency from the range of maximum jetting frequencies that results in a minimum velocity spread across the subharmonic frequencies.

12. The test system of claim 9 wherein:

the determination device selects the maximum jetting frequency from the range of maximum jetting frequencies that results in a minimum drop placement spread across the subharmonic frequencies.

13. The test system of claim 9 wherein:

the determination device determines a mass/frequency curve for the inkjet head, and determines the failure zones in the mass/frequency curve.

14. The test system of claim 9 further comprising:

a test stand that secures the inkjet head;

an ink supply that supplies a print fluid to the inkjet head;

a test drive circuit that supplies a drive waveform for driving the inkjet head; and a droplet analyzer that measures drop velocity of the inkjet head over a set of increasing frequencies in the drive waveform.

15. The test system of claim 9 further comprising:

a jetting simulator that simulates jetting of the inkjet head over a set of increasing frequencies to generate the velocity/frequency curve.

16. The test system of claim 9 wherein:

the determination device determines a Helmholtz frequency (H) of the inkjet head, determines a first one of the failure zones around H/2, and determines a second one of the failure zones around 2H/3.

17. The test system of claim 9 further comprising:

a user interface that receives performance goals for the inkjet head from a user, wherein the performance goals include at least one of a minimum velocity spread across the subharmonic frequencies and a minimum drop placement spread across the subharmonic frequencies.

18. A non-transitory computer readable medium embodying programmed instructions executed by a processor to implement a method for selecting a maximum jetting frequency for an inkjet head, wherein the instructions direct the processor to:

generate a velocity/frequency curve for the inkjet head;

determine failure zones in the velocity/frequency curve that comprise frequencies in the velocity/frequency curve resulting in jetting failure of the inkjet head;

determine a range of maximum jetting frequencies of the inkjet head that are higher than the frequencies of the failure zones, wherein subharmonic frequencies of each of the maximum jetting frequencies are outside of the failure zones; and select a maximum jetting frequency for the inkjet head from the range of maximum jetting frequencies.

19. The computer readable medium of claim 18 wherein the instructions direct the processor to:

select a highest frequency in the range of maximum jetting frequencies as the maximum jetting frequency.

20. The computer readable medium of claim 18 wherein the instructions direct the processor to:

determine a Helmholtz frequency (H) of the inkjet head;

determine a first one of the failure zones around H/2; and determine a second one of the failure zones around 2H/3.

* * * * *